US006273281B1

(12) United States Patent
Berglund

(10) Patent No.: US 6,273,281 B1
(45) Date of Patent: Aug. 14, 2001

(54) ADJUSTABLE SHELVING SYSTEM

(75) Inventor: Terrence G. Berglund, Hales Corners, WI (US)

(73) Assignee: DCI Marketing, Inc., Milwaukee, WI (US)

( * ) Notice: Subject to any disclaimer, the term of this patent is extended or adjusted under 35 U.S.C. 154(b) by 0 days.

(21) Appl. No.: 09/663,027

(22) Filed: Sep. 15, 2000

(51) Int. Cl.[7] ..... A47F 5/00

(52) U.S. Cl. ..... 211/187; 211/192; 248/243; 108/107; 108/147.11

(58) Field of Search ..... 211/187, 90.02, 211/186, 192; 108/107, 147.11, 148; 248/243

(56) References Cited

U.S. PATENT DOCUMENTS 2,733,037 * 1/1956 Dunham .
2,990,067 * 6/1961 Bartlett .
3,294,250 * 12/1966 Evans .
3,367,291 * 2/1968 Evans .
3,536,015 * 10/1970 Textoris ..... 248/243 X
3,677,416 * 7/1972 Block et al. .
4,421,239 * 12/1983 Vargo ..... 211/187
4,513,669 * 4/1985 Steinke ..... 248/243 X
4,892,044 * 1/1990 Welsh ..... 211/187 X
5,199,585 * 4/1993 Schafer ..... 211/187
5,350,073 * 9/1994 Thornley et al. ..... 211/187

* cited by examiner

*Primary Examiner*—Robert W Gibson, Jr.

(57) ABSTRACT

A shelving system includes a shelf and at least one leg. A finger is supported by the shelf and is extendable through an aperture in the skirt of the shelf. The finger includes a base portion and a retaining portion angled with respect to the base portion. A biasing member biases the finger toward a retracted position. The leg includes a slot having a wide portion and a narrow portion. The finger is movable against the biasing force of the biasing member to be received within the narrow portion of the slot such that the leg is sandwiched between the retaining portion of the finger and the skirt of the shelf. The shelf may be removed from the slot by moving the retaining portion of the finger into alignment with the wide portion of the slot in the leg such that the biasing member retracts the finger from the slot.

20 Claims, 5 Drawing Sheets

18
C
74
22
46
110
54
58
106
14
86
90
122
62
42
118
6
5
B
A

ADJUSTABLE SHELVING SYSTEM

FIELD OF THE INVENTION

The invention relates to an adjustable shelving system.

BACKGROUND

It is known to provide modular shelving systems including legs and shelves. Typically the shelves are mounted to the legs with fasteners. Often the fasteners are tightened and loosened with tools to permit the shelves to be adjusted.

SUMMARY

The present invention provides a shelving system and a method for easily adjusting the height of a shelf without removing any other shelves in the system. The shelving system includes a leg, a shelf, and a self-retractable finger clip insertable into the leg from within the boundaries of the shelf. The finger clip is movable between an extended position and a retracted position with respect to a peripheral skirt of the shelf. The leg may include a slot having a wide portion and a narrow portion. The finger may include a base portion and a retaining portion angled with respect to the base portion. The finger is received within the narrow portion of the slot such that the leg is sandwiched between the retaining portion of the finger and the skirt of the shelf. A biasing member biases the finger toward the retracted position to create a clamping force on the shelf skirt and the leg.

The shelf is removable from the slot by moving said shelf to align the retaining portion of the finger with the wide portion of the slot such that the biasing member retracts the finger from the slot. The shelf may then be moved to align the finger with a second slot on the leg. The finger is manually moved to the extended position to insert the retaining portion of the finger into the wide portion of the second slot. Then the shelf is moved to cause the finger to move into the narrow portion of the second slot and sandwich the leg between the retaining portion of the finger and the skirt of the shelf.

Other features and advantages of the invention will become apparent to those skilled in the art upon review of the following detailed description, claims, and drawings.

Figure 1:
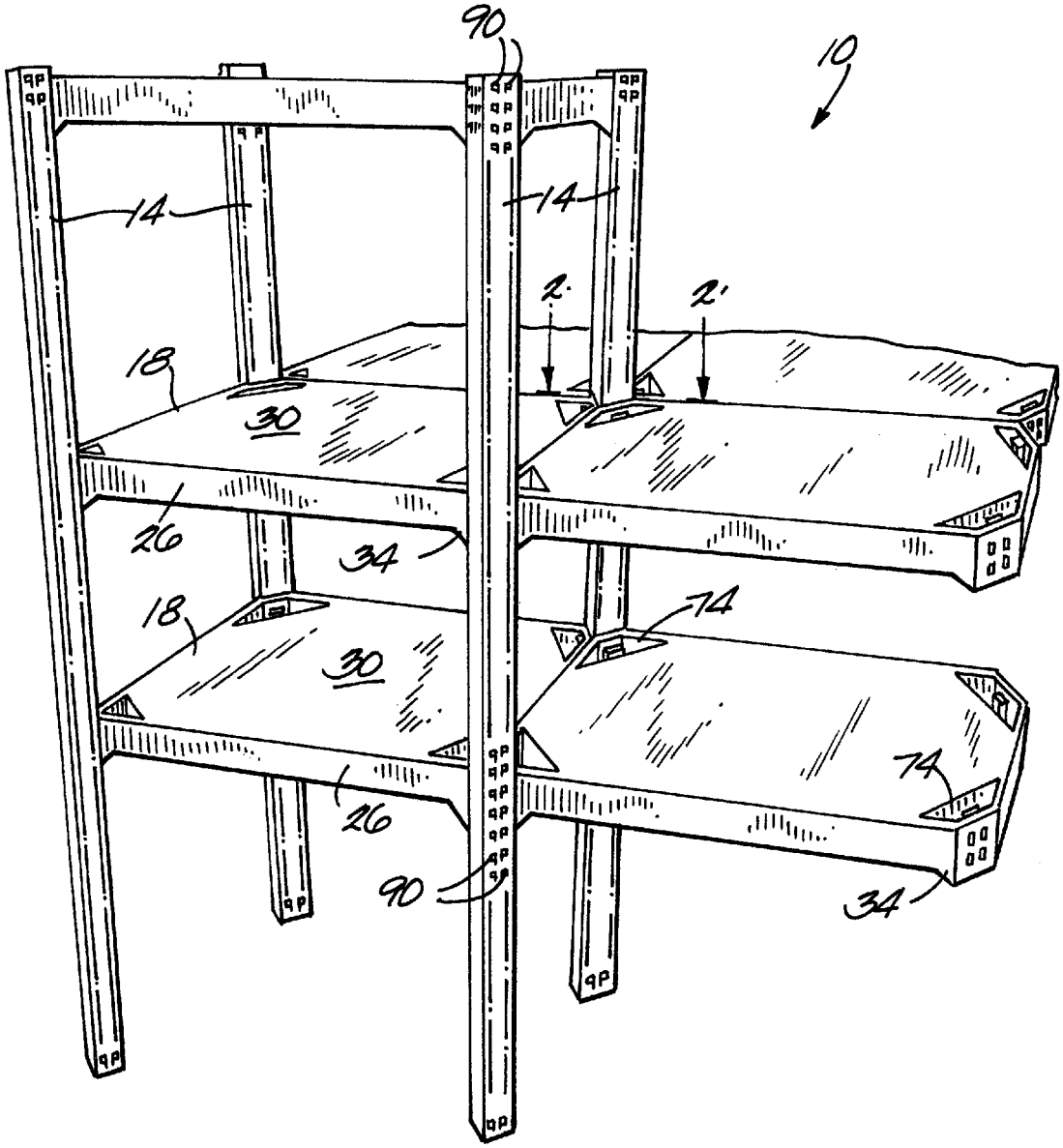
FIG. 1 is a perspective view of a shelving system embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

FIG. 1 depicts an adjustable shelving system 10 embodying the present invention. More specifically, the illustrated shelving system 10 includes legs 14 and shelves 18 that are removably connected to the legs 14 with a coupler 22 (FIGS. 2–7). The coupler 22 is positioned within the boundaries of the shelf 18 when in a retracted position (see shelves labeled A and B in FIG. 2). As used herein, "within the boundaries" means that, when viewed from above, substantially the entire coupler 22 is positioned within the outermost edge of the shelf 18. Among other advantages, this construction permits the shelf 18 to have a side profile that is substantially unbroken by the coupler 22, and permits the shelf 18 to fit snugly between the legs 14 without bowing the legs 14 to accommodate the coupler 22.

Figure 2:
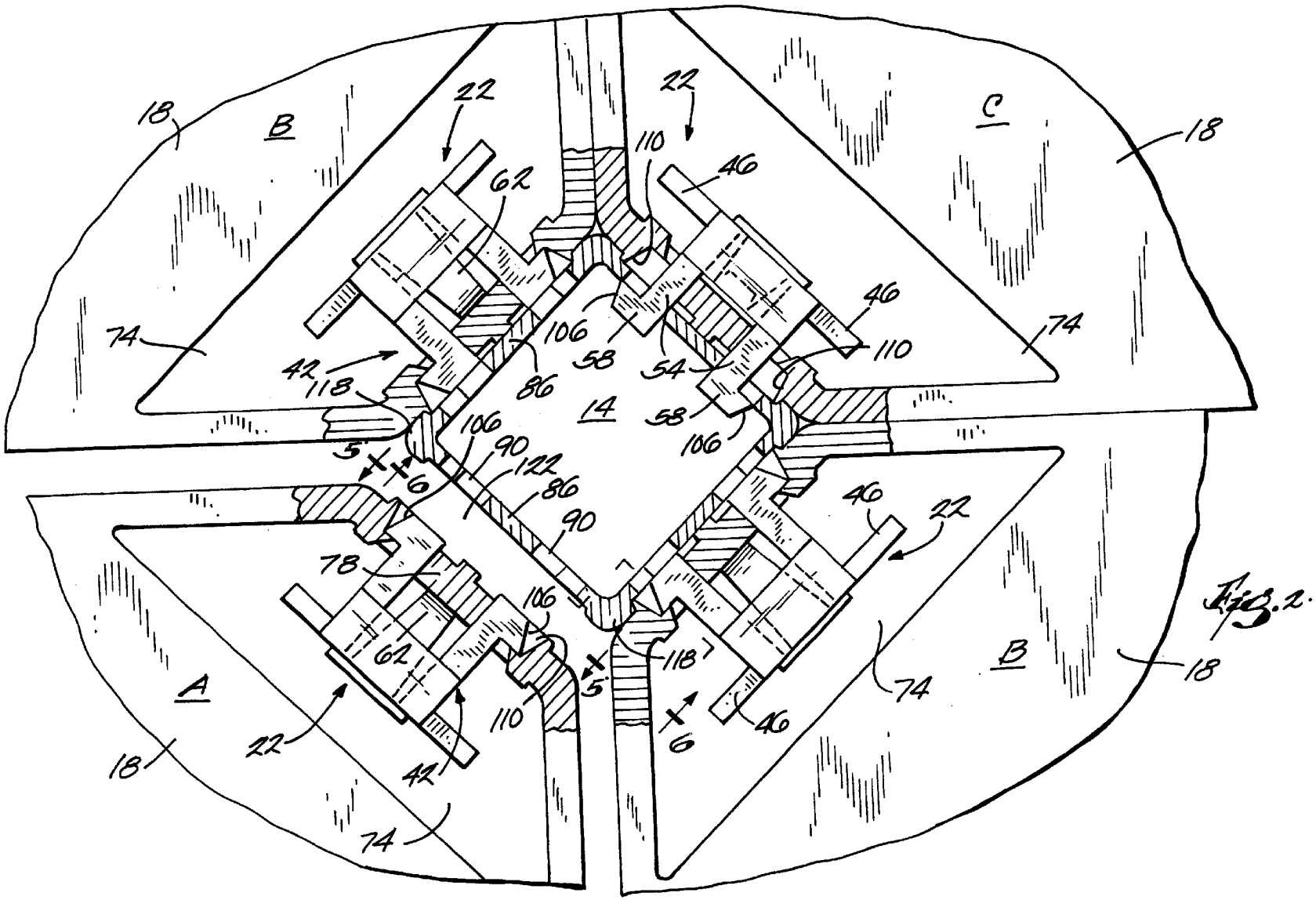
FIG. 2 is a view taken along line 2—2 of FIG. 1 illustrating the stages of shelf-finger-leg engagement.
Figure 5:
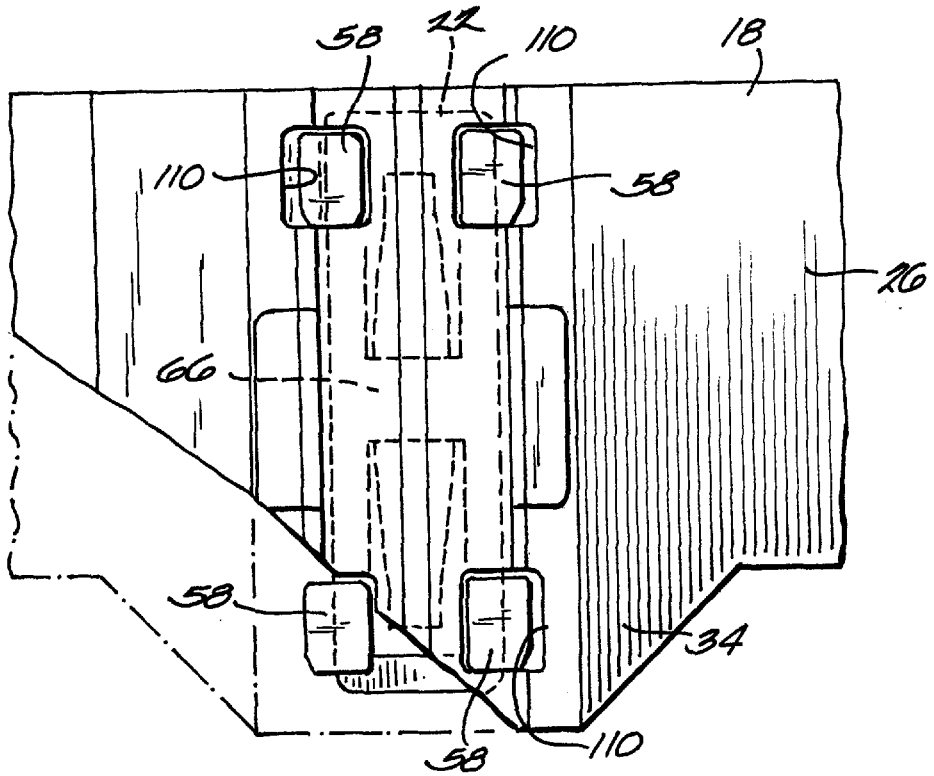
FIG. 5 is a cross-section view taken along line 5—5 in FIG. 2.

The shelves 18 illustrated in FIG. 1 include a depending peripheral skirt 26 extending down from a top portion 30. The top potion 30 is used to support objects placed upon the shelf 18. As illustrated in FIG. 2, the corners of each shelf 18 are angled to allow four shelves 18 to attach to a single leg 14. The illustrated shelves 18 are thus rectangular in shape with mitered or beveled corners. The shelves 18 include truss structures 34 at the corners for added support there.

The size of the shelving system 10 can be adjusted by adding or subtracting legs 14 and/or shelves 18. In this regard, the shelving system 10 is modular. The smallest shelving system 10 of the illustrated embodiment consists of four legs 14 and one shelf 18. The shelving system 10 may be expanded vertically by securing additional shelves 18 between the existing four legs 14, or horizontally by adding additional legs 14 to support the corners of each additional shelf 18. The illustrated embodiment thus enables a shelving system 10 of endless duration.

Of course, the shelving system 10 may be constructed other than as illustrated. For example, the shelving system 10 may be based on three legs 14 and triangular shaped shelves 18, or more than four legs 14 and appropriate polygonal-shaped shelves 18. One or more of the legs 14 may alternatively be replaced with slots in a wall or other suitable stable structure.

Figure 3:
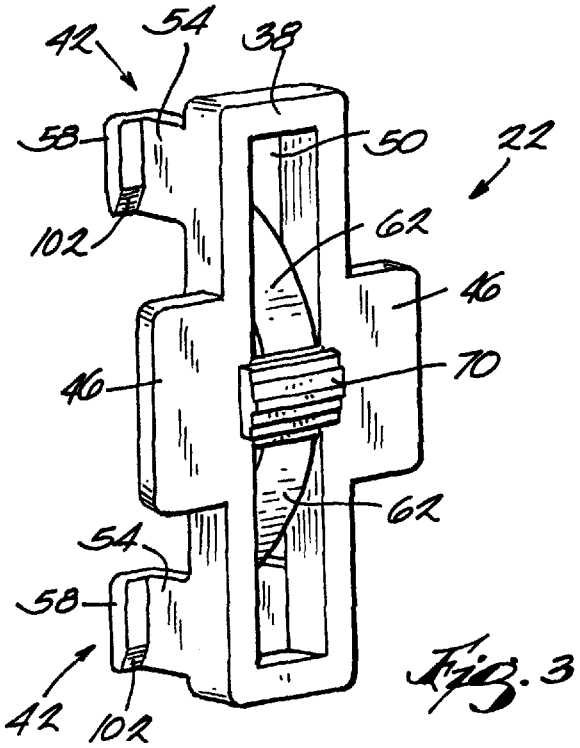
FIG. 3 is a perspective view of a coupler used in the shelving system of FIG. 1.
Figure 4:
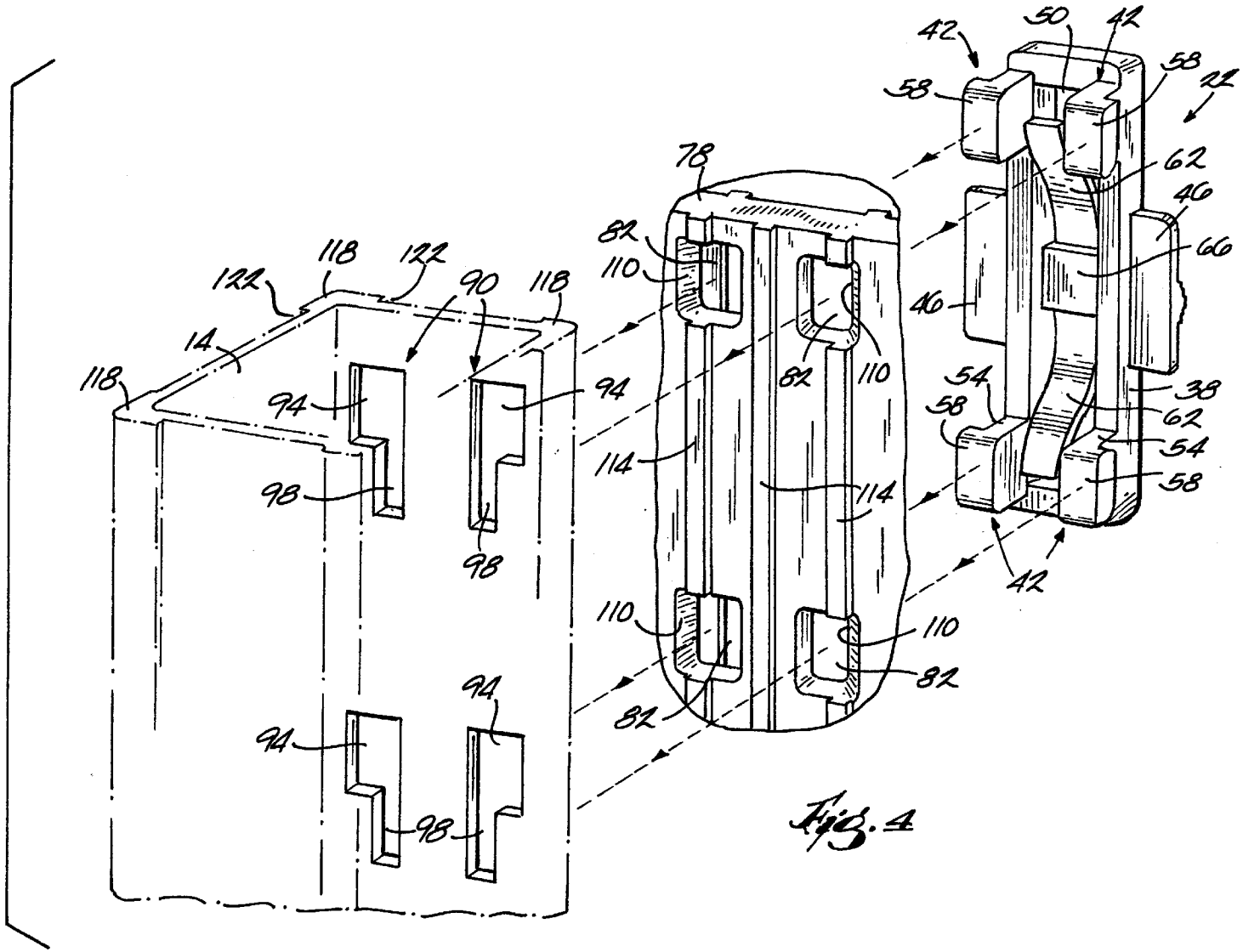
FIG. 4 is an exploded perspective view of a portion of the shelving system of FIG. 1.

As best illustrated in FIGS. 3 and 4, the coupler 22 includes a frame 38 and a plurality of fingers 42 depending from the frame 38. The frame 38 includes a pair of wings 46 which help actuation of the coupler 22, as described in more detail below. The frame 38 is preferably a rectangular shape surrounding an elongated opening 50. Each finger 42 is substantially L-shaped and includes a base portion 54 and a retaining portion 58 angled with respect to the base portion 54. The couplers 22 also include a biasing member or spring consisting of a pair of leaf spring members 62 extending into the elongated opening 50 from a cross-member 66 of the frame 38. The cross-member 66 includes a gripping surface 70 including several steps. The entire coupler 22 is preferably a single injection-molded part, with the frame 38, fingers 42, cross-member 66, and leaf spring members 62 being formed integrally.

Referring to FIGS. 1, 2, 4, and 5, the illustrated shelves 18 include cutouts 74 at each corner into which a coupler 22 is positioned. The corners thus include a corner wall 78 which in the illustrated embodiment is part of the peripheral skirt 26. The cutouts 74 are large enough to accommodate a person's hand so that the person can actuate the coupler 22. The corner wall 78 includes four recessed apertures 82 (FIG. 4) through which the fingers 42 extend. The apertures 82 are small enough so that the retaining portions 58 of the fingers 42 are not permitted to pass through the apertures 82 in the normal operating orientation of the coupler 22. The leaf spring members 62 abut the inner surface of the corner wall 78 and bias the retaining portions 58 of the fingers 42 into the recessed apertures 82 and biases the coupler 22 away from the inner surface.

Alternatively, the shelves 18 may have solid top surfaces 30 (i.e., without the cutouts 74) such that the skirts 26 of the shelves 18 define downwardly-opening cavities, and the couplers 22 may be accessible from under the shelves 18 only. In another alternative embodiment, the depending peripheral skirts 26 may be removed, although this may result in reduced stiffness of the shelves 18, in which case the couplers 22 would depend from the top portion 30 of the shelf and be visible when the shelves 18 are viewed from the side. A truss or gusset structure (not shown) between the underside of the top portion 30 and the couplers 22 may be used to provide structural support for the couplers 22 in such a construction.

Figure 7:
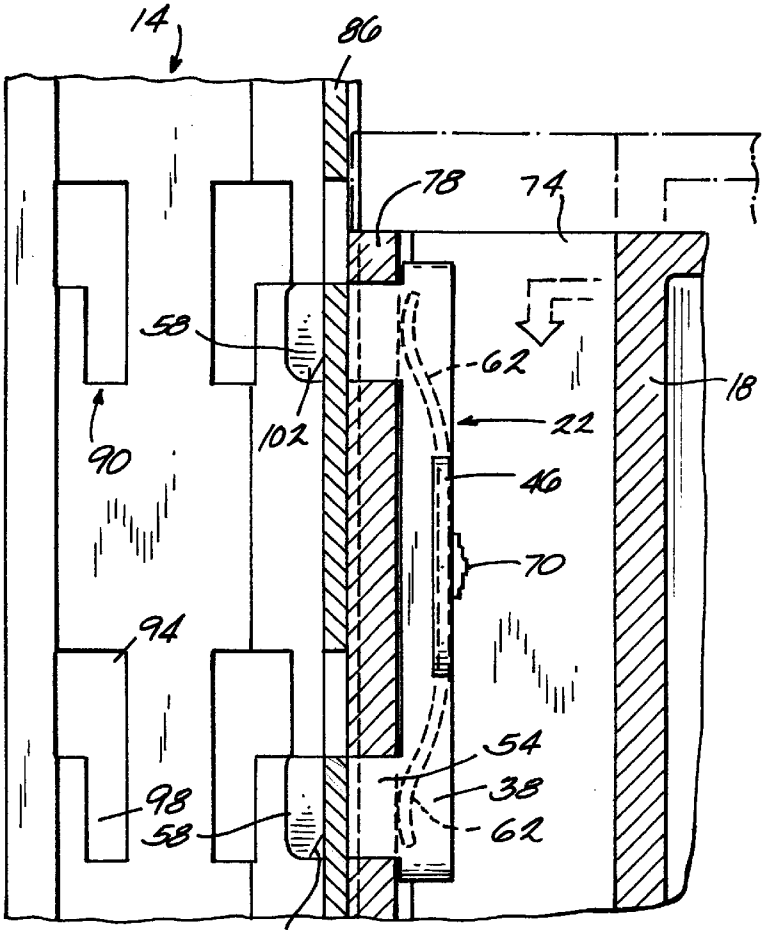
FIG. 7 is a view similar to FIG. 6 illustrating the finger in the extended position engaging the slot of a leg.
Figure 6:
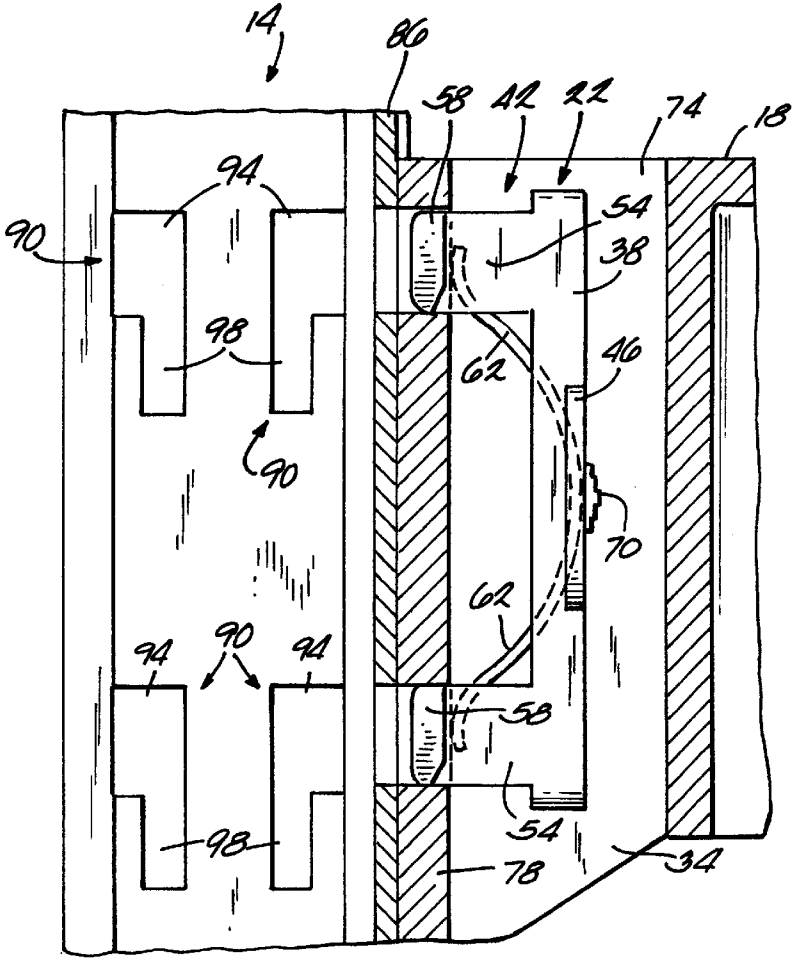
FIG. 6 is a cross-section view taken along line 6—6 in FIG. 2, illustrating the finger in the retracted position.

As seen best in FIGS. 6 and 7, the legs 14 include leg walls 86 having slots 90 including a wide portion 94 and a narrow portion 98. The slots 90 are arranged in two columns up the height of each leg 14. The columns and slot s 90 within the columns are spaced so that the recessed apertures 82 of the shelves 18 may be aligned with a selected group of four slots 90.

In operation, a shelf 18 is moved into position (see shelf "A" in FIG. 2) adjacent a leg 14. The corner of the shelf 18 is positioned against the leg 14 with the four recessed apertures 82 aligned with the wide portions 94 of four slots 90 (see shelves "B" in FIG. 2). As illustrated in FIG. 6, the leaf spring members 62 bias the coupler 22 toward the center of the shelf 18 such that the retaining portions 58 of the fingers 42 are held in the recessed apertures 82. As mentioned above, this is referred to herein as the "retracted position."

Once aligned with the slots 90, the coupler 22 may be pressed against the shelf corner wall 78 by pressing against the wings 46 of the coupler 22. As the coupler 22 is pressed against the corner wall 78 of the shelf 18, the leaf spring members 62 are flattened (as in FIG. 7) and the retaining portions 58 of the fingers 42 extend through the wide portions 94 of the slots 90 in the legs 14 (see shelf "C" in FIG. 2). This is referred to herein as the "extended position." With the fingers 42 extending through the wide portions 94 of the slots 90, the shelf 18 is then moved (e.g., lowered in the illustrated embodiment) so that the fingers 42 are moved into the narrow portions 98 of the slots 90. The retaining portions 58 include ramped surfaces 102 (FIG. 3) to facilitate moving the fingers 42 into the narrow portions 98 of the slots 90.

Once the fingers 42 are positioned in the narrow portions 98 of the slots 90, the leg wall 86 is sandwiched between the retaining portions 58 and the corner wall 78 of the shelf 18 (i.e., the retaining portion 58 is now inside the leg 14, behind the leg wall 86). The leaf spring members 62 bias the coupler 22 toward the retracted position, thereby positively pinching the leg wall 86 between the retaining portion 58 and the corner wall 78.

The shelf 18 may be quickly removed from its present setting by pushing on the shelf 18 from underneath or hooking the gripping surface 70 of the cross member 66 with a person's finger. The retaining portions 58 of the fingers 42 may then be slid into alignment with the wide portions 94 of the slots 90. Once this alignment has been achieved, the biasing force of the leaf spring members 62 withdraws the fingers 42 from the slots 90, and the coupler 22 is again in the retracted position. In this regard, the coupler 22 is self-extracting, self-retracting, or automatically able to extract itself from the s lots 90 upon alignment of the retaining portions 58 of the fingers 42 with the wide portions 94 of the slots 90.

The shelf 18 may then be moved up or down into alignment with a different set of slots 90, and secured at the new location as described above. Because of the substantially unbroken shelf profile provided by the coupler construction when the coupler 22 is in the retracted position, the shelves 18 are adjustable without bowing the legs 14 to any significant degree and without having to remove other shelves 18 in the system 10.

Certain additional features of the present invention facilitate operation of the illustrated coupler 22. As seen in FIG. 2, the retaining portions 58 include angled surfaces 106 to guide the retaining portions 58 through the wide portions 94 of the slots 90 in the event there is a small misalignment therebetween. The recessed apertures 82 of the shelf corner wall 78 include guide surfaces 110 that guide the retaining portions 58 into the recessed apertures 82 as the coupler 22 moves from the extended position to the retracted position.

The corner walls 78 of the shelves 18 preferably include stiffening ribs 114 (FIG. 4) that add to the shelfs rigidity. The legs 14 include corner caps 118 (FIGS. 2 and 4) adjacent to which the corner wall ribs 114 are positioned to permit the shelves 18 to be slid vertically into alignment with the selected group of slots 90. In this regard, the end caps 118 define sidewalls for a track 122 between the corner caps 118, and the ribs 114 slide along the sidewalls of the track 122. The corner caps 118 are preferably formed integrally with the leg walls 86, but may be provided separately.

What is claimed is:

1. A shelving system comprising:

a shelf having a peripheral skirt;

a finger movable between an extended position and a retracted position with respect to said skirt, said finger including a base portion and a retaining portion angled with respect to said base portion;

a biasing member biasing said finger toward said retracted position; and a leg at least partially supporting said shelf and including a slot having a wide portion and a narrow portion, said finger being received within said narrow portion of said slot such that said leg is sandwiched between said retaining portion of said finger and said skirt of said shelf;

whereby said shelf is removable from said slot by moving said shelf to align said retaining portion of said finger with said wide portion of said slot such that said biasing member retracts said finger from said slot.

2. The system of claim 1, wherein said finger is substantially L-shaped.

3. The system of claim 1, wherein said shelf includes a corner, said finger being positioned at said corner of said shelf.

4. The system of claim 1, wherein said slot is arranged vertically, and wherein said wide portion of said slot is at the top of said slot and said narrow portion of said slot extends down from said wide portion.

5. The system of claim 1, wherein said finger is constructed of polycarbonate.

6. The system of claim 1, wherein said biasing member is an arc of resilient material.

7. The system of claim 1, wherein said skirt includes a ramped guide surface to facilitate guiding said finger toward said retracted position.

8. The system of claim 1, wherein said retaining portion includes a ramped surface to facilitate sliding said finger into said narrow portion of said slot.

9. The system of claim 8, wherein said finger is a first finger, said system further comprising a frame to which said first finger is mounted, and second, third, and fourth fingers substantially identical to said first finger and mounted to said frame such that said first, second, third, and fourth fingers are movable together.

10. The system of claim 9, further comprising a pair of wings mounted to said rectangular frame to facilitate manually moving said fingers toward said extended position against the biasing force of said biasing member.

11. The system of claim 9, further comprising a cross-member extending across a portion of said rectangular frame, wherein said biasing member includes an arc of resilient material mounted to said cross-member.

12. The system of claim 1, further comprising end caps on said legs, said end caps including sidewalls defining a track therebetween, said slots being positioned within said track, wherein said shelf skirt includes a pair of stiffeners extending into said track and slidable along said sidewalls to permit vertical movement of said shelf with respect to said leg.

13. A shelving system comprising:

a shelf having an outermost boundary when viewed from above;

a self-retracting coupler including at least one finger and a biasing member, said coupler being supported by said shelf and movable between a retracted position in which said entire coupler is positioned within said boundary and an extended position in which at least a portion of said finger extends outside of said boundary, said biasing member biasing said coupler toward said retracted position; and a leg including apertures into which said finger extends when said coupler is in said extended position to support said shelf;

wherein said finger is retractable from said aperture in said leg under the influence of said biasing member upon movement of said shelf.

14. The shelving system of claim 13, wherein said biasing member includes an arc of resilient material.

15. The shelving system of claim 13, wherein said shelf includes a top portion and a peripheral skirt depending from said top portion, wherein said coupler is supported by said peripheral skirt, and said biasing member provides a clamping force to clamp said leg and said peripheral skirt together.

16. The shelving system of claim 15, wherein said peripheral skirt includes an outer surface positioned adjacent said leg, said biasing member exerting a biasing force against said inner surface to bias said coupler away from said inner surface.

17. The shelving system of claim 15, wherein said finger extends through said skirt.

18. A method for adjusting a shelf, the method comprising the acts of:

(a) providing a leg having first and second slots;

(b) providing a shelf;

(c) providing a coupler including a finger and movable between a retracted position in which the coupler is within the boundary of the shelf and an extended position in which a portion of the finger extends outside of the boundary of the shelf;

(d) mounting the coupler to the shelf by extending a portion of the finger through the first slot;

(e) biasing the finger toward the retracted position to sandwich the leg and shelf together with the finger;

(f) moving the shelf such that the finger retracts from the first slot under the biasing force;

(g) moving the shelf to align the finger with the second slot;

(h) moving the coupler into the extended position to extend at least a portion of the finger through the second slot; and (i) biasing the finger toward the retracted position to sandwich the leg and shelf together with the finger.

19. The method of claim 18, wherein the slots provided in act (a) include a wide portion and a narrow portion, and wherein act (d) includes extending the finger through the wide portion of the first slot and moving the finger into the narrow portion of the first slot.

20. The method of claim 19, wherein act (f) includes moving the shelf to align the finger with the wide portion of the first slot.

* * * * *